United States Patent [19]

Thompson, Jr. et al.

[11] Patent Number: 4,804,809

[45] Date of Patent: Feb. 14, 1989

[54] MOTOR OPERATOR FOR PADMOUNT SWITCHGEAR

[75] Inventors: Parke Thompson, Jr., St. Louis; Lloyd R. Beard; Melvin B. Goe, Jr., both of Centralia, all of Mo.

[73] Assignee: A. B. Chance Company, Centralia, Mo.

[21] Appl. No.: 112,415

[22] Filed: Oct. 26, 1987

[51] Int. Cl.[4] ..... H01H 3/00

[52] U.S. Cl. ..... 200/17 R; 200/47

[58] Field of Search ..... 200/17 R, 18, 38 E, 200/47, 158, 153 LA; 74/89.15, 424.8 R, 424.4 VZ, 424.8 A; 192/138, 141, 94

[56] References Cited

U.S. PATENT DOCUMENTS

| | | | |
|---|---|---|---|
| 2,944,436 | 7/1960 | Pickles | 192/141 |
| 3,247,732 | 4/1966 | Barnhart | 200/47 X |
| 3,682,283 | 8/1972 | Sato | 192/141 |
| 3,996,697 | 12/1976 | Bailey et al. | 318/266 X |
| 4,114,747 | 9/1978 | Eller | 200/47 X |
| 4,250,762 | 2/1981 | Weatherby | 74/89.15 |
| 4,552,403 | 11/1985 | Yindra | 74/89.15 X |

*Primary Examiner*—J. R. Scott

*Attorney, Agent, or Firm*—Hovey, Williams, Timmons & Collins

[57] ABSTRACT

A motor operator for local or remote shifting of switchgear contacts toward either open or closed positions includes a reversible motor and rotatable drive screw mounted on common support structure for simultaneous pivoting movement as a drive nut translates fore-and-aft along the length of the screw. The drive nut includes an outer body and an inner sleeve which is set into free-wheeling motion whenever the sleeve comes into contact with either of two stops mounted on the screw defining respective end limits of travel for the nut. A drive element normally coupling the nut to an operating shaft of the switchgear is removable to allow the shaft to be manually rotated with a wrench when desired, and removal of the drive element reduces the likelihood that the worker is injured upon unintentional activation of the motor while the operating shaft is turned by hand.

9 Claims, 4 Drawing Sheets

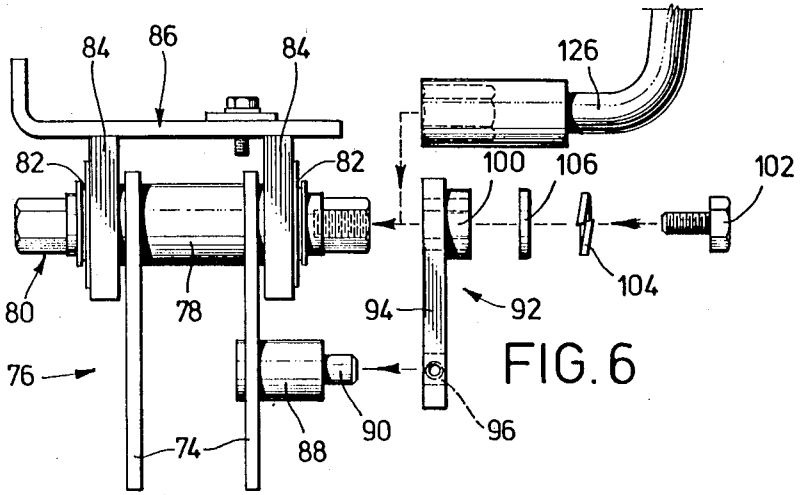
FIG. 6
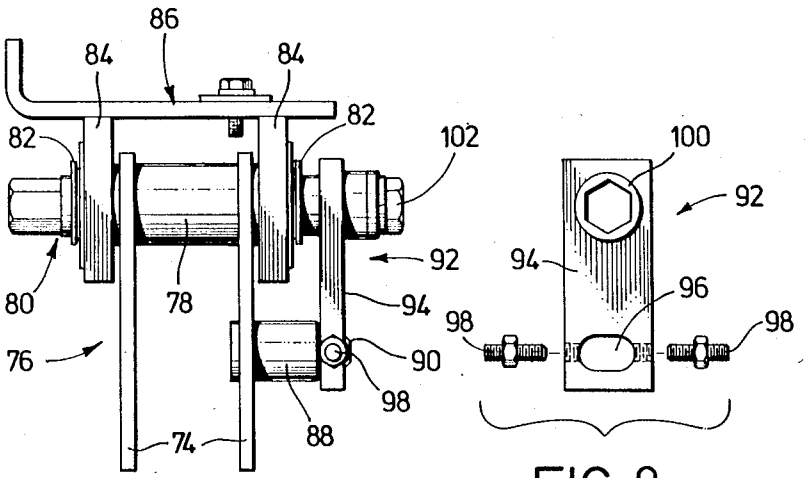
FIG. 8
FIG. 7
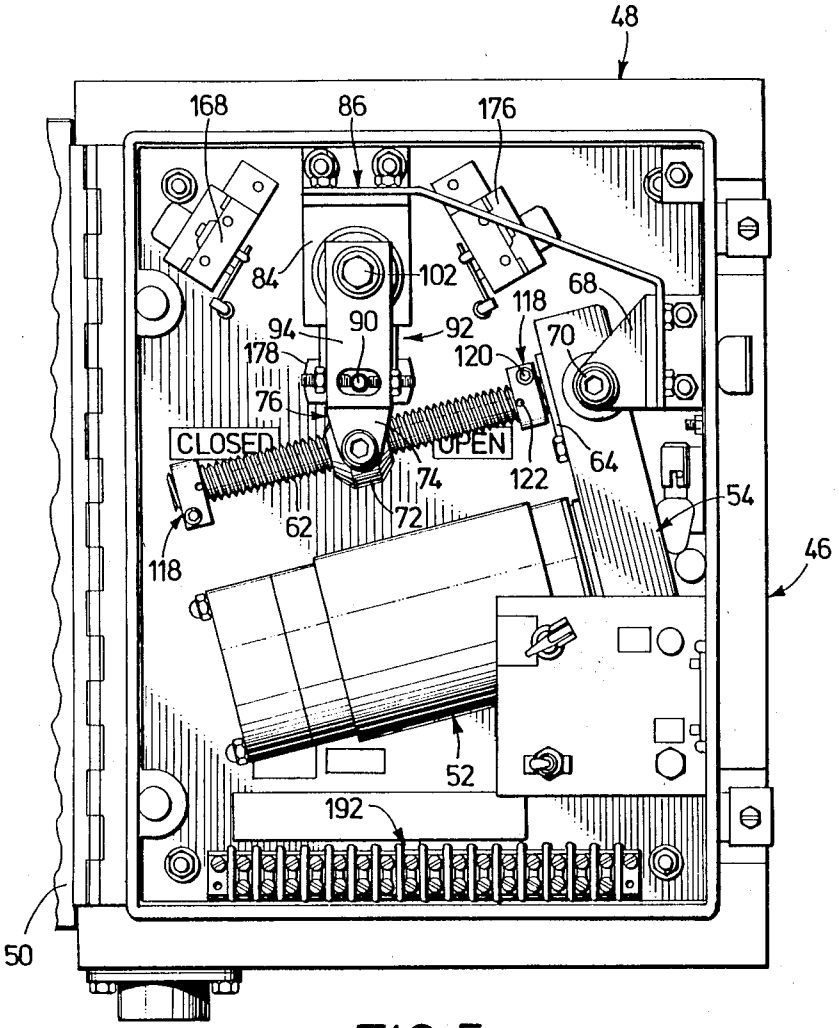
FIG. 5

MOTOR OPERATOR FOR PADMOUNT SWITCHGEAR

BACKGROUND OF THE INVENTION

1. Field of the Invention

This invention relates to a motor operator for opening or closing contacts of pad-mounted switchgear adapted for use in high voltage underground distribution systems. Drive components of the operating mechanism are constructed in such a fashion that the overall size of the motor operator is relatively compact and may be readily mounted as a retrofit unit on the side of an existing switchgear cabinet. The motor of the operator may be activated either locally or remotely to open or close the contacts; alternatively, a drive element normally coupling the motor to the contact operating shaft is selectively removable so that a wrench may be used to manually open and close the contacts when necessary. Removal of the drive element substantially precludes accidental injury during use of the wrench if the motor is unintentionally actuated.

2. Description of the Prior Art

Underground electrical transmission and distribution systems include a main service line leading from a substation with a number of individual distribution lines connected in parallel to the main line at strategic points along the length of the latter. It is often the practice, particularly where power is supplied to a user entity such as a shopping center or discrete residential development to provide padmounted switchgear in each of the lateral distribution lines connected to the main in order to allow selective de-energization of that lateral distribution line without the necessity of de-energizing all of the lateral distribution lines because of the service main. Switchgear apparatus conventionally includes electrical, movable contacts which may be opened and closed by maintenance personnel, as well as fuse structure which protects the line from the influence of high or low level faults that may occur in one of the branch laterals. In a particularly useful type of switchgear, vacuum switches are employed for circuit control and which are mounted under oil along with the fusing structure to minimize the overall size of the switchgear housing.

Generally, the vacuum switch contacts of padmounted switchgear as described require snap action opening and closing mechanism to minimize arcing and assure a positive closing of the switch contacts. Actuation of the switch operating mechanism is normally accomplished by hand. In some cases, however, motor operators have been installed within the switchgear cabinet for powered actuation of the opening and closing mechanism. Recently, there has been increased interest in switch contact actuating mechanism that is motor operated and can be activated at remote locations as well as locally by a switch within the cabinet.

Certain of the known switchgear motor operators are relatively bulky, however, and are adapted to be installed only within the main housing or cabinet of the switchgear. By design, these units are not suitable for installation on a retrofit basis on an external side of an existing switchgear cabinet. Moreover, most of the available motor gear operators are relatively expensive, both in terms of cost for the various components as well as the expenses for installation of the same. Furthermore, these units do not readily lend themselves to manual actuation in the event of motor failure or in the event the operator desires to open the switch contacts by hand. Hence, there is a need for a motor operator which overcomes these and other problems associated with known devices.

SUMMARY OF THE INVENTION

The present invention is directed toward a switchgear motor operator of relatively compact dimensions that may be easily installed on an external side of an existing switchgear cabinet. Moving components of the motor operator are arranged to provide reliable service within a limited space and over extended periods of time, and a relatively simple, quick conversion mechanically disables the motor operator from the switchgear operating mechanism for manual opening and closing of the mechanism when desired.

More particularly, the motor operator includes a drive unit assembly comprising a reversible motor and a rotatable drive screw interconnected by a gear belt. A nut advances along the length of the screw during rotation of the motor and screw and is straddled by a clevis assembly connected thereto that, in turn, is linked to an operating shaft connected to an opening and closing mechanism of the switchgear. Advancement of the nut in either direction along the screw pivots the shaft in order to operate the switch contact opening and closing mechanism as desired.

The motor and drive screw of the drive unit assembly are mounted on a common support for simultaneous pivotal movement relative to the cabinet as the motor is actuated to advance the nut and operate the switchgear. Pivotal movement of the drive unit assembly accommodates swinging motion of the nut in an arc with the clevis assembly as the nut travels along the length of the screw, and consequently allows the overall size of the operator to be relatively small so that the same may be installed within a compact housing mounted on the side of the cabinet.

In preferred forms of the invention, the drive nut which travels along the length of the screw has structure for free-wheeling motion when the nut reaches either of two end limits located near respective, opposite end portions of the screw. In this manner, damage to the nut or other components of the operator is avoided during continued rotation of the drive screw after the nut has reached either end limit of the screw. Specifically, the nut is provided with an internal sleeve that is freely rotatable relative to an external body of the nut whenever an outwardly projecting end portion of the sleeve comes into contact with stops that are fixed to opposite end portions of the screw.

The motor operator mechanism may be activated locally by a push button switch mounted inside a housing enclosing the operator, or optionally may be controlled at a remote location by a manual or automatic switch. If desired, a drive element normally linking the nut-supporting clevis assembly and a shaft coupled to the opening and closing mechanism of the switchgear may be removed in the field and a wrench placed upon the shaft for opening and closing of the contacts by hand. In accordance with the invention, however, access to the shaft for engagement with a wrench is precluded unless the drive element is first removed, and therefore injury to the worker is substantially avoided if, for example, the motor is unintentionally energized while the wrench is in contact with the shaft.

BRIEF DESCRIPTION OF THE DRAWINGS

FIG. 5 is an enlarged, fragmentary, side elevational view somewhat similar to FIG. 4 wherein a drive motor and screw have pivoted about a common horizontal axis relative to their positions depicted in FIG. 4 as occurs when the motor operator is actuated to open or close switchgear contacts;

FIG. 6 is an enlarged, fragmentary, front elevational view in exploded format of a clevis assembly and drive coupling means normally connecting the drive unit to an operating shaft of the switchgear and schematically depicting for exemplary purposes optional placement of a wrench for manually opening and closing switchgear contacts after removal of a drive element normally connecting the clevis assembly to the operating shaft;

FIG. 7 is an enlarged, front elevational view of the clevis assembly and drive coupling means shown in FIG. 6, illustrating the normal disposition of the drive element for mechanically linking the clevis assembly to the operating shaft of the switchgear;

FIG. 8 is an enlarged, side elevational view in exploded form of the removable drive element depicted in FIGS. 6 and 7:

DETAILED DESCRIPTION OF THE DRAWINGS

Figure 1:
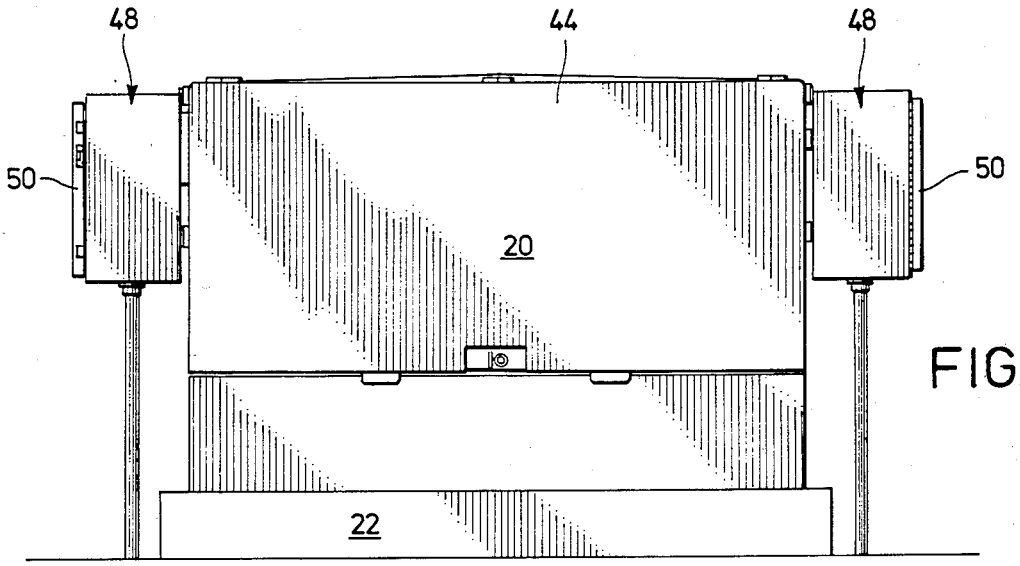
FIG. 1 is a front elevational view of a pad-mounted switchgear assembly having two motor operators constructed in accordance with the invention mounted on respective sides of a switchgear cabinet.
Figure 2:
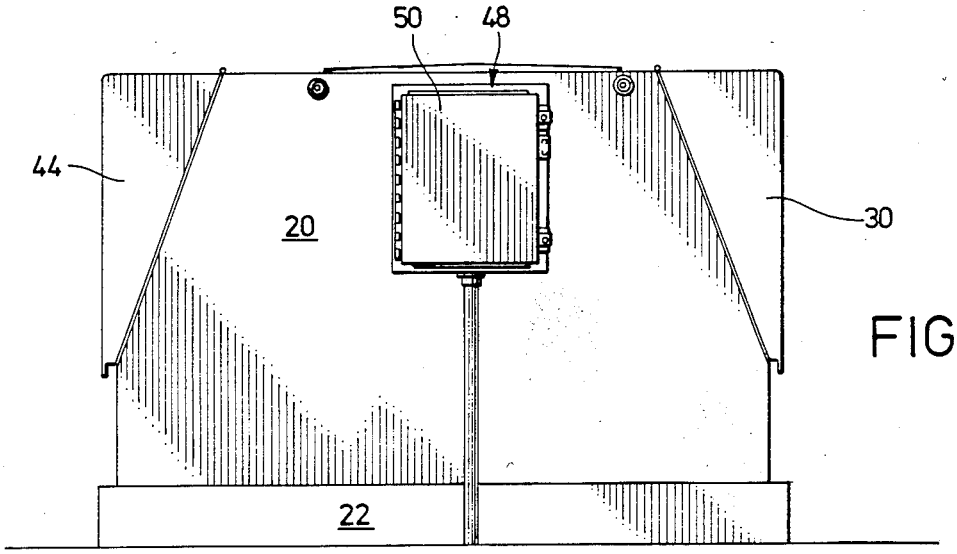
FIG. 2 is a side elevational view of the switchgear assembly and motor operator shown in FIG. 1.

Referring initially to FIGS. 1 and 2, a switching cabinet 20 comprising an upright, rigid box-like structure is mounted on a footing such as an above-ground concrete pad 22. The cabinet includes, as shown in FIG. 3, an internal tank 24 containing a quantity of fluid dielectric material such as oil, and a fuse well 26 extending within the tank 24 electrically connected to a bushing 28 secured to a rear side of the tank and accessible by means of a hinged door 30.

Figure 3:
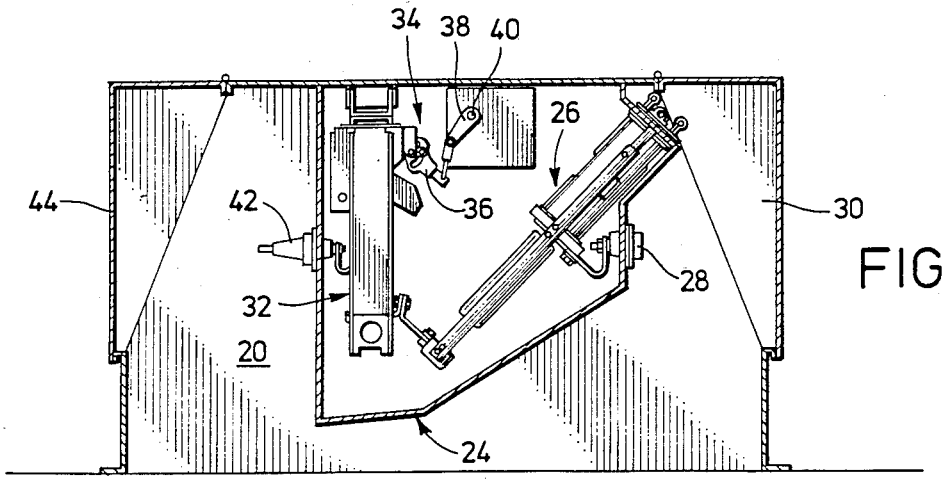
FIG. 3 is a side cross-sectional view of the cabinet shown in FIGS. 1 and 2, illustrating fuse structure, switchgear supports, and other components mounted internally within the cabinet.

As shown in FIG. 3, a support structure 32 carries, for example, three vacuum bottle assemblies that are immersed within the oil and which include contacts that are operatively coupled to a switch opening and closing mechanism 34. The mechanism 34 includes an operating handle 36 connected by a swinging link 38 to a horizontally extending switchgear operating shaft 40, the end of which is shown in FIG. 3.

A more detailed understanding of the opening and closing mechanism 34 may be gained by reference to similar structure that is disclosed in pending application Ser. No. 06/900,538, filed Aug. 26, 1986, now U.S. Pat. No. 4,713,503 and assigned to the assignee of the present invention. In essence, pivotal movement of the operating shaft 40 about its longitudinal axis in one direction causes the mechanism 34 to open contacts of all three vacuum bottles to simultanteously break respective phases of a branch line, while pivotal movement of the shaft 40 in the opposite direction causes mechanism 34 to simultaneously shift the contacts toward each other to thereby close the circuits. Each of three primary bushings 42 is electrically coupled to one of the vacuum bottles through a front wall of tank 24 for connection to a corresponding primary phase line; bushings 42 are accessible by means of a hinged front door 44.

A motor operator, broadly designated 46 in FIGS. 4–10, is enclosed within a compact housing 48 mounted on a side of the cabinet 20 as is shown in FIGS. 1 and 2. In instances where the cabinet 20 contains six vacuum bottle assemblies for controlling two three-phase branch lines, separate motor operators 46 mounted within respective housings 48 are installed on each side of the cabinet 20 as illustrated in FIG. 2 for powered opening and closing of either branch line as may be needed.

Figure 4:
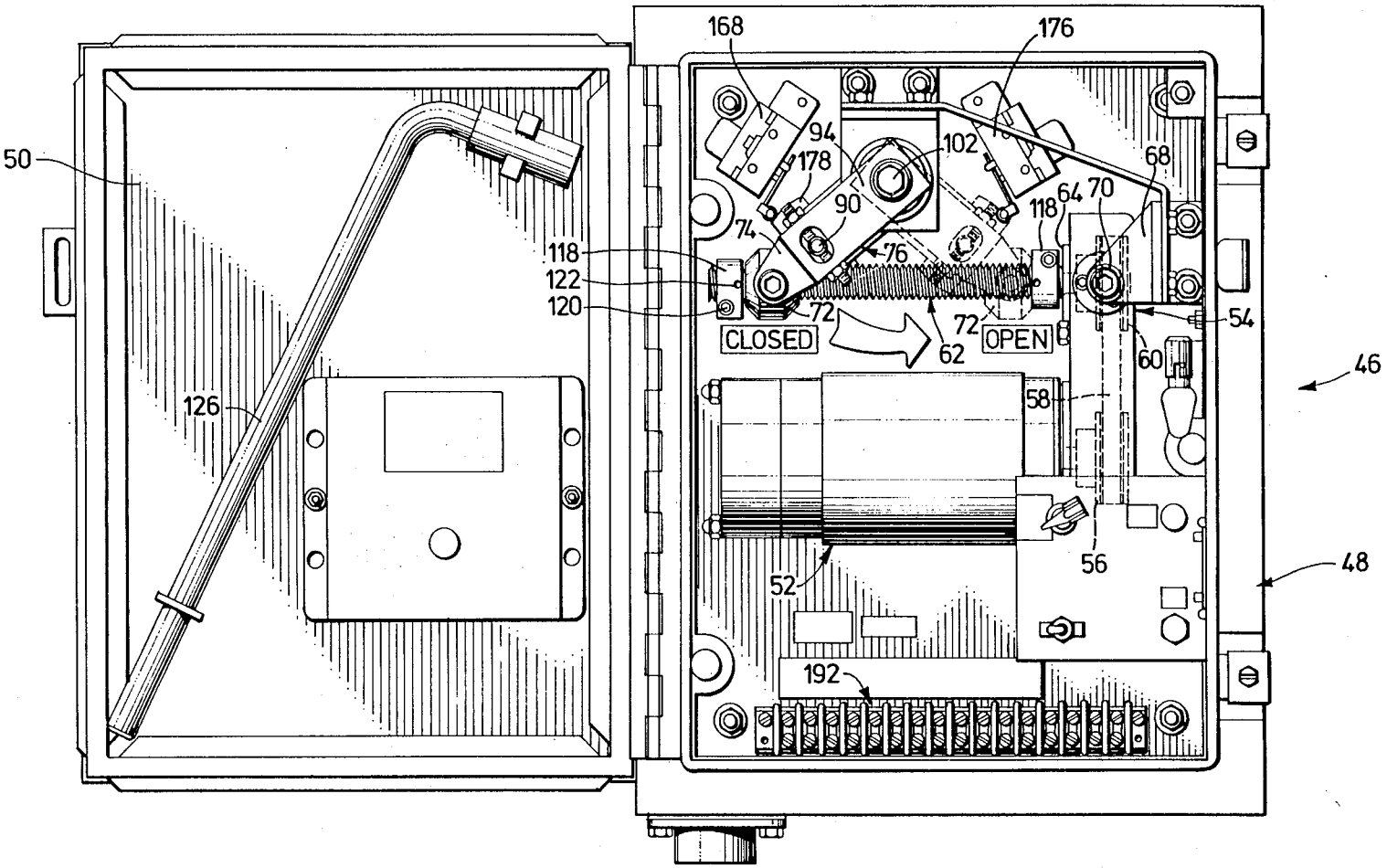
FIG. 4 is an enlarged, side elevational view of the motor operator shown in FIGS. 1 and 2, with a door of the housing opened to reveal a drive mechanism of the operator.

A hinged door 50 of the housing 48 may be opened from the positions shown in FIGS. 1–2 to the orientation depicted in FIGS. 4–5 in order to gain access to the motor operator 46 and the local controls therefor. The motor operator mechanism includes a reversible, direct current motor 52 mounted on supporting structure 54 that takes the form of an elongated, transversely U-shaped beam. An output shaft of motor 52 is fixedly connected to a pulley 56 as shown by the dashed lines in FIG. 4, and a toothed belt 58 interconnects pulley 56 with another pulley 60 secured to an end portion of an elongated drive screw 62. The drive screw 62 is supported on the structure 54 by means of a bearing 64.

A bracket 68, in the form of a clevis, is fixedly connected to the motor operator housing 48 as can be understood by reference to FIGS. 4 and 5. Pivot means 70 connects opposed, spaced sides of the support structure 54 to respective, opposite arms of the bracket 68 for swinging movement of structure 54 about a horizontal axis during operation of the motor 52 as will be explained in the following paragraphs in further detail.

A drive nut 72 is rotatably mounted on the drive screw 62 and is translatable fore-and-aft along the length thereof during operation of motor 52 to rotate screw 62. The drive nut 72 is straddled by opposed legs 74 of a clevis assembly 76 that is also shown in FIGS. 6 and 7. Each leg 74 of clevis assembly 76 is pivotally connected to a corresponding side portion of the drive nut 72 to enable swiveling motion of the latter about a horizontal axis as the nut 72 advances in either direction along the length of screw 62.

Energization of motor 52 rotates pulley 56 to advance the belt around its closed loop path of travel to thereby simultaneously turn pulley 60 along with drive screw 62. Rotation of the drive screw 62 advances the drive nut 72 along the length of the screw 62 in a direction in accordance with the direction of rotation of the latter. The drive nut 72 is shiftable along screw 62 between end limits of the same defined by stops 118. In FIG. 4, the end limits of travel of the drive nut 72 along the length of the screws 62 are shown by the full line and dashed line depiction respectively.

Referring to FIGS. 6 and 7, the clevis assembly 76 includes a cylindrical sleeve 78 fixedly joined on opposite end portions to one end of each leg 74. The sleeve 78 is mounted on a connecting shaft 80 for free-swinging, pivotal motion relative to the latter. In turn, the connecting shaft 80 is received within bearings 82 that are coupled to spaced, depending legs 84 of a shaft support bracket assembly 86 that is fixed to housing 48 (in this regard, see also FIGS. 4 and 5).

The outwardmost leg 74 of clevis assembly 76 carries a stud 88 having an outwardly extending, generally cylindrical head 90 of reduced diameter. A drive coupling means is also provided made up of clevis assembly 76 and a removable coupling device broadly designated 92. The coupling device 92 includes an arm or drive element 94 (see also FIG. 8) that has an opening 96 adjustably defined on opposite sides by screws 98. The drive element 94 comprises an elongated, flat plate and an outwardly projecting socket 100 fixed to an end portion of the plate remote from opening 96.

The socket 100 of drive element 94 has a polygonal opening that is complemental in configuration to a polygonal in cross-section end portion of connecting shaft 80. As shown in FIG. 6, the end portion of connecting shaft 80 is received within the opening of socket 100 as the opening 96 of drive element 94 is simultaneously received on the head 90 of stud 88. A bolt 102 extends through a lock washer 104 and a flat washer 106 and is threaded into a complementally threaded bore formed in the polygonal end portion of connecting shaft 80 to releasably fix the drive element 94 to connecting shaft 80 while also mechanically linking the latter to legs 74 of clevis assembly 76.

Although not shown, a floating sleeve interconnects a polygonal end portion of connecting shaft 80 to the operating shaft 40 of the switchgear operating mechanism 34. The sleeve is formed with an internal channel that is polygonal in cross-section and complemental in configuration to a polygonal end portion of connecting shaft 80 as well as a polygonal end portion of the switchgear operating shaft 40.

Figure 10:
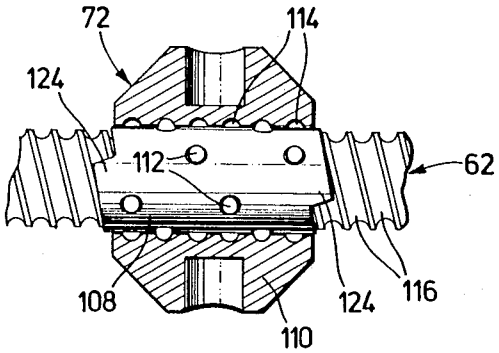
FIG. 10 is an enlarged, fragmentary, essentially side cross-sectional view depicting a free-wheeling internal sleeve of a drive nut that is threadably received on the powered, rotatable drive screw of the operator which is also illustrated in FIGS. 4 and 5.

Viewing FIG. 10, the drive nut 72 has structure for freewheeling motion whenever the drive nut 72 reaches either of two end limits located on opposite end regions of the drive screw 62. More particularly, the structure for freewheeling motion includes a generally cylindrical sleeve 108 that extends through a central bore formed in a body 110 of the nut 72. The sleeve 108 has eleven circular openings that each receive a respective ball 112, and the balls 112 ride within the confines of circular grooves 114 formed in walls defining the bore of body 110, as well as helical grooves 116, 116 presented by the double flighting of screw 62.

Two stops 118, 118 are disposed on opposite end portions of the drive screw 62 to define respective end limits for the extent of travel of the nut 72. As illustrated in FIGS. 4 and 5, each of the stops 118 is in the form of an annular collar which is split on one side thereof and is clamped to the screw 62 upon tightening of a bolt 120. Each of the stops 118 has a short, internal cylindrical wall that is spaced away from the threads of drive screw 62 in an area to either side of pins 122, for permitting limited entry of an outwardly projecting end portion of the sleeve 108 within the annular space between a portion of stop 118 and screw 62.

Turning again to FIG. 10, each end portion of sleeve 108 is formed with two outwardly projecting shoulders 124 disposed 180° apart from each other about the central axis of sleeve 108. As the drive nut 72 approaches either of the stops 118, the adjacent end portion of the sleeve 108 is received in the annular space between stop 118 and the drive screw 62 until the shoulders 124 come into a position of contact with respective pins 122. Further rotation of the drive screw 62 by motor 52 causes the sleeve 108 in contact with pins 122 to rotate simultaneously with rotation of the screw 62 and thereby cause balls 112 to circle around respective grooves 114 in the body 110, enabling the latter to remain in a stationary position relative to the screw 62. However, whenever the drive nut 72 is spaced from the stops 118 so that the shoulders 124 are out of engagement with pins 122, the balls 112 have sufficient frictional engagement with grooves 114 such that the sleeve 108 is maintained in stationary relationship with respect to the nut body 110, consequently enabling the latter to advance in either direction along the length of drive screw 62 during operation of motor 52.

Figure 9:
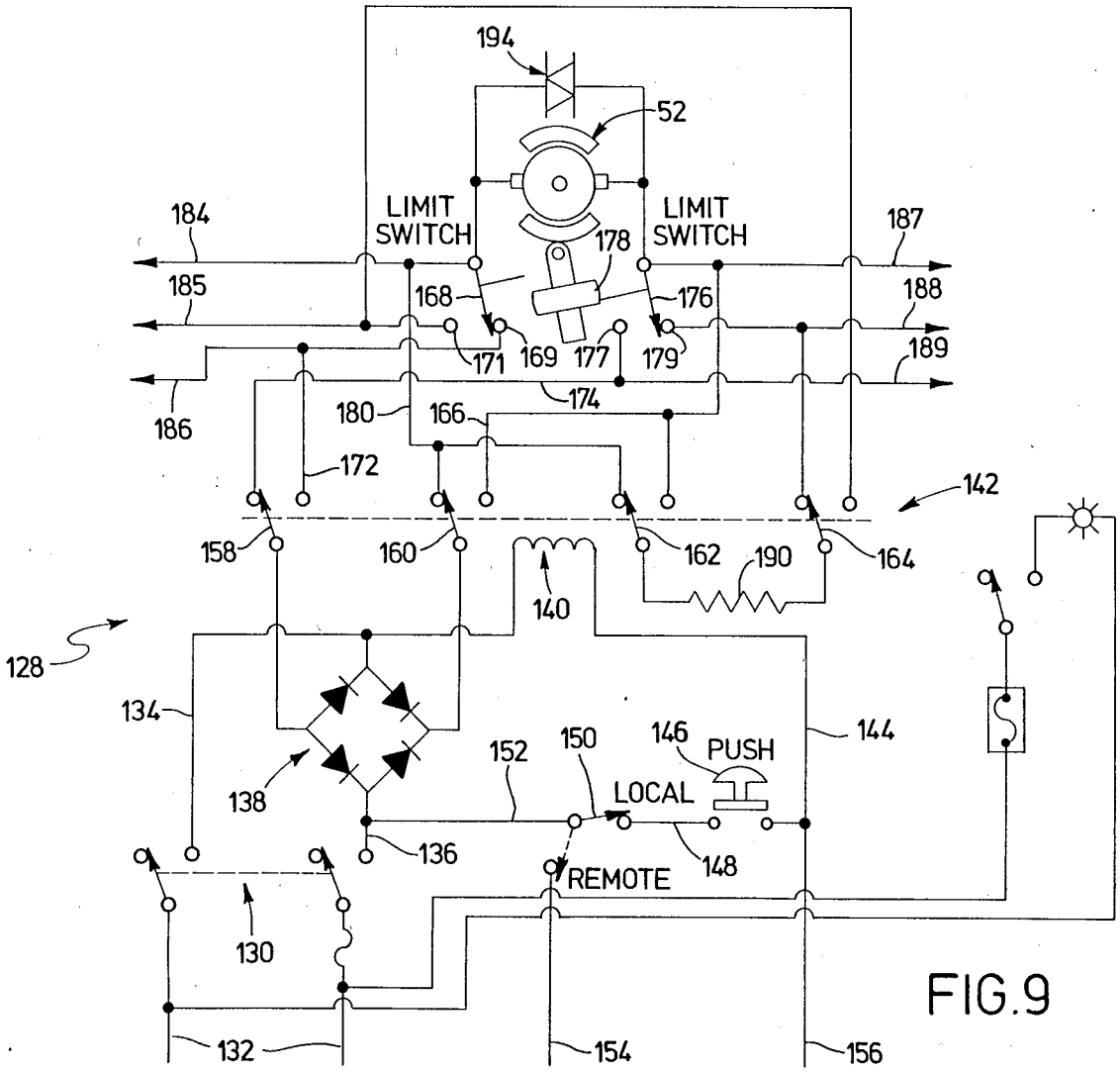
FIG. 9 is a schematic diagram of a control circuit for local or remote operation of the motor of the drive unit assembly which is shown in FIGS. 4 and 5.

Referring now to FIG. 9, an electrical schematic of a control circuit 128 for operation of the motor 52 is shown and includes a main power switch 130 that receives, via leads 132, 132, single phase, alternating current, electrical power of a suitable level such as 110 volts. The switch 130 is electrically coupled to leads 134, 136 that are connected to a diode bridge rectifier network 138. In addition, lead 134 is connected to a coil 140 of a four pole, double throw impulse relay 142 that, in turn, is connected by a lead 144 to one terminal of a single pole, normally open push button switch 146. The opposite terminal of switch 146 is electrically linked by a lead 148 to a snap action, single pole double throw switch 150 that has a central contact lever connected by a lead 152 to lead 136.

Switch 150 enables the control of motor operator 46 to be effected either locally (i.e., within housing 48 as shown in FIGS. 4 and 5) or remotely by a signal arriving, for example, from a microwave transmission or another source of telecommunication. When switch 150 is in the position shown by the dashed line in FIG. 9, completion of the circuit across leads 154, 156 has essentially the same effect as operation of the push button 146 when the switch 150 is in its full-line position shown in FIG. 9. In either case, momentary completion of the circuit between leads 144 and 152 energizes coil 140 to snap four power relay switches 158, 160, 162, 164 of relay 142 to an orientation opposite their current orientation. That is to say, momentary energization of coil 140 snaps the switches 158–164 alternatively during sequential cycles of operation in opposite directions from one contact to another.

When coil 140 of relay 142 is energized to shift the relay switches 158–164 away from their full-line position shown in FIG. 9 and toward a position of engagement with the remaining contacts, direct current filtered from the alternating current by bridge network 138 flows from switch 160 through a lead 166, to the reversible D.C. motor 52 through a normally closed limit switch 168, then through a lead 172 and through lead 174 back toward the relay switch 158. The limit switch 168, as well as a limit switch 176 are double throw and spring biased toward a normally closed position toward terminals 169, 177 respectively, and are opened relative to terminals 169, 177 and closed relative to terminals 171, 179 whenever a cam 178 comes into contact with an operating arm of either of the switches 168, 176. The cam 178 is also shown in FIGS. 4 and 5, and is mounted on the rear leg 74 of the clevis assembly 76. Viewing FIG. 4, lower outer edge portions of the cam 178 contact a roller on the operating arm of either of the limit switches 168, 176 whenever the drive nut 72 closely approaches the corresponding end limit of travel in directions along the fore-and-aft axis of drive screw 62.

Thus, once motor 52 is activated to cause the drive nut 72 to shift from the dashed line or switchgear contact open position shown in FIG. 4 to the full-line or switchgear contact closed position illustrated in FIG. 4, cam 178 engages the operating arm of limit switch 168 to break the circuit and disable the motor 52. Thereafter, motor 52 will remain at rest until relay coil 140 is again energized.

Subsequent local or remote momentary energization of coil 140 flips the relay switches 158–164 back toward their full-line position depicted in FIG. 9. At this time, direct current from relay switch 160 flows along a lead 180, through motor 52 and through a lead 174 toward relay switch 158 thereby causing the motor 52 to rotate in a reverse direction relative to the operation of the motor 52 described in the immediately proceeding paragraphs. The motor 52 rotates to shift the drive nut 72 toward the opposite end of drive screw 62 (FIG. 4) until cam 178 comes into contact with the operating arm of limit switch 176. At this time, the cam 178 opens limit switch 176 to isolate lead 174 from lead 180 and thereby interrupt the flow of current to motor 52.

A five ohm resistor 190 is coupled across relay switches 162, 164 and provides dynamic, EMF braking of the motor 52 once cam 178 engages either of limit switches 168, 176 and power to motor 52 is interrupted. The mechanical momentum of the motor armature causes the D.C. motor 52 to behave as a generator and resistor 190 functions to provide a load for motor 52 and quickly halt continued rotation of the armature. In this regard, it is to be noted that the actual time for travel of the nut 72 from one of the end limit stops 118 to another is preferably on the order of less than 0.5 seconds, and thus dynamic braking of motor 52 is desirable for rapidly quenching mechanical energy of the same.

Preferably, the stops 118 on the drive screw 62 (FIGS. 4 and 5) are located such that the pins 122 engage the sleeve 108 and cause free-wheeling motion of the latter shortly after the time that the cam 178 has sufficiently shifted the operating arms of limit switches 168, 176 to move their respective switch arms away from their normal operating position. In this manner, continued rotation of screw 62 after contact of sleeve 108 with pins 122 sets sleeve 108 into free-wheeling motion thereby enabling body 110 to remain stationary so that components of the drive mechanism, including the nut, screw and associated linkages, are not subjected to undue stress and possible damage.

The screws 98 advantageously compensate for mechanical tolerances of the various components and also compensate for the polygonal interconnection between socket 100 and shaft 80 by enabling the rotative position of legs 74, 74 to be adjusted during installation of the operator 46 to thereby coordinate the rotative position of shaft 80 and operating shaft 40 of the switch gear opening and closing mechanism 34 with the position of nut 72 along the length of screw 62. Screws 98 can be adjusted to ensure that the nut 72 is in its proper position in contact with one of the stops 118, 118 when the operating shaft 40 has been turned in either direction to cause the opening and closing mechanism 34 to either open or close the contacts. Moreover, the provision of screws 98 enables the length of drive screw 62 to be minimized, since the length of screw 62 need not be substantially longer than the length necessary to accommodate travel of nut 72 during opening or closing of the switch gear mechanism 34, in addition to the length of screw necessary to provide sufficient space to mount both of the stops 118, 118.

Optionally, leads 184–189 shown in FIG. 9 may be operatively connected to a local or remote indicator such as signal lamps for providing information as to whether the contacts of the switchgear are in an open circuit or in a closed circuit position. Leads 184–189 as well as leads 132, 154, and 156 are preferably connected to a terminal strip 192 conveniently located within a bottom portion of housing 48 as is shown in FIGS. 4 and 5. Finally, a transient current suppressor 194 is connected across the terminals of motor 52 to provide surge protection for the latter.

By comparison of FIGS. 4 and 5, it can be observed that the drive nut 72 travels in an arc with an end portion of the legs 74 as the nut 72 moves from one end of the screw 62 toward the other. In order to accommodate swinging motion of the nut 72, the drive unit assembly comprising the motor 52 and screw 62 are mounted for simultaneous swinging movement on support structure 54 about pivot means 70. Advantageously, common mounting of the motor 52 and drive screw 62 on support structure 54 for simultaneous pivoting motion about pivot means 70 enables the overall size of the motor operator 46 to be smaller than other constructions.

In addition, the drive coupling means 92 of the present invention represents an advance in the art since the operating shaft 40 of the switchgear may be manually opened or closed in the field without the use of motor 52. To effect manual operation of the switchgear opening and closing mechanism, bolt 102 (see FIGS. 6 and 7) is removed from connecting shaft 80 to allow the drive element 94 to thereafter be separated from the polygonal end portion of connecting shaft 80 as well as the pin-like head 90 of stud 88. Next, as shown in FIG. 6, a wrench 126, having a polygonal-in-cross-section socket complemental in shape to the polygonal end portion of connecting shaft 80, is placed over the shaft 80 and the handle of wrench 126 is swung in an arc to rotate connecting shaft 80 along with the operating shaft 40 to either open or close the contacts. Importantly, manipulation of the connecting shaft 80 with wrench 126 is precluded until drive element 94 is removed to uncouple clevis assembly 76 from shaft 80. As a consequence, unintentional energization of motor 52 and resultant swinging of legs 74 of clevis assembly 76 does not impart movement to the wrench 126 which might otherwise result in injury to the worker grasping the same.

The provision of the removable drive element 94 also allows the motor operator 46 to be tested without interrupting service to the branch line. The worker can, for instance, push switch 146 after removal of element 94 to check for proper operation of the motor 52, drive screw 62, nut 72 and control circuit 128 as well as other components of the motor operator 46 without disturbing the switchgear opening and closing mechanism 34 so that the branch line may be continuously energized. This aspect of the invention represents a particularly desirable feature since under normal operating conditions the operator 46 is activated, if at all, only on a relatively infrequent basis.

We claim:

1. A motor operator for switchgear, said switchgear including a switch mechanism for opening and closing the switch contacts, and movable linkage means coupled with said mechanism for causing selective shifting movement thereof to effect opening or closing of the switch contacts in response to movement of the linkage means, said motor operator comprising:

an elongated, threaded screw;

a nut threadably mounted on said screw and translatable fore-and-aft along the length thereof;

selectively operable motor means operatively coupled with said screw for axially rotating the latter;

pivot structure mounting said screw and the motor means for pivoting movement thereof as a unit about a common axis while preventing axial movement of the screw with respect to the pivot axis of the structure;

movable output means for operative connection with said linkage means in order to move said linkage means for actuating said mechanism to open or close the switch contacts; and drive coupling means pivotally connected to said nut and drivingly coupled to said output means for, in response to axial rotation of said screw, causing said nut to translate along the screw and to move the output means as the screw and motor means pivot as a unit about said common axis.

2. The mechanism of claim 1, including a pair of stops respectively adjacent the ends of said screw, said nut being selectively free wheeling upon engagement with a respective stop.

3. The mechanism of claim 1, said output means comprising an axially rotatable shaft having a polygonal in cross section drive portion, said drive coupling means including a drive element operatively connected with said nut and having a polygonal opening mated with said drive portion of the shaft and drivingly receiving the latter, and means releasably connecting said element and shaft drive portion allowing removal of the drive element in the filed so that said shaft may be rotated manually independent of the nut and said motor means to permit selective manual operation of the mechanism to open and close the switch contacts.

4. The mechanism of claim 3, said drive coupling means further having an elongated leg pivotally connected to said nut and pivotally supported by said shaft, and means for releasably connecting said drive element to said leg, said leg being rotatable relative to said shaft upon disconnection of said drive element from said leg.

5. A motor operator for switchgear, said switchgear including a switch mechanism for opening and closing the switch contacts, and movable linkage means coupled with said mechanism for causing selective shifting movement thereof to effect opening and closing of the switch contacts in response to movement of the linkage means, said motor operator comprising:

an elongated threaded screw;

a nut threadable mounted on said screw and translatable fore-and-aft along the length thereof;

selectively operable motor means operatively coupled with said screw for axially rotating the latter;

support structure supporting the screw and motor means for pivoting movement thereof as a unit about a common axis while preventing axial movement of the screw with respect to the pivot axis of the structure;

a shaft mounted for rotation about an axis spaced from and parallel to the axis of pivoting of the screw and said motor means, said shaft being adapted to shift said linkage to operate said switch mechanism in response to rotation of the shaft; and drive coupling means pivotally joined to said nut and drivingly connected to said shaft for rotating the latter in one direction in response to translation of the nut on the screw in one direction and for rotating the shaft in the opposite direction as the nut translates on the screw in the opposite direction of travel of the nut.

6. A motor operator as set forth in claim 5, wherein the axis of rotation of the shaft and the axis of pivoting movement of the drive coupling means with respect to the nut and the axis of pivoting of the screw and motor mean are all in spaced, parallel relationship.

7. A motor operator as set forth in claim 5, wherein the axis of the motor means and the axis of the screw are in parallel, spaced relationship and perpendicular to the axis of the shaft.

8. A motor operator as set forth in claim 5, wherein said drive coupling means includes releasable means for releasably connecting the nut to said shaft to permit disconnection of the nut from the shaft so that the latter may be manually rotated at will to shift the linkage means and actuate the contact opening and closing switch mechanism.

9. A motor operator for switchgear, said switchgear including a switch mechanism for opening and closing the switch contacts, said motor operator comprising:

a shaft for effecting actuation of the switch opening and closing mechanism;

an elongated threaded screw;

a nut threadably mounted on said screw and translatable fore-and-aft along the length thereof;

selectively operable motor means operatively connected with said screw for axially rotating the latter;

support structure supporting the screw and motor means for pivoting movement thereof as a unit about a common axis while preventing axial movement of the screw with respect to the pivot axis of the structure;

movable output means for operative connection with said mechanism for actuating the latter to open and close the switch contacts; and drive coupling means pivotally connected to said nut and drivingly coupled to said output means for, in response to axial rotation of said screw, causing said nut to translate along the screw and to move the output means as the screw and motor means pivot as a unit about said common axis.

* * * * *